US012520870B1

(12) United States Patent
Nelson

(10) Patent No.: US 12,520,870 B1
(45) Date of Patent: Jan. 13, 2026

(54) CIGAR CASE

(71) Applicant: Gregarious Cigars LLC, Surfside, FL (US)

(72) Inventor: Linden David Nelson, Surfside, FL (US)

(73) Assignee: Gregarious Cigars LLC, Surfside, FL (US)

( * ) Notice: Subject to any disclaimer, the term of this patent is extended or adjusted under 35 U.S.C. 154(b) by 0 days.

(21) Appl. No.: 19/283,003

(22) Filed: Jul. 28, 2025

(51) Int. Cl.
*A24F 15/20* (2006.01)
*A24F 25/00* (2006.01)
*A45F 5/00* (2006.01)

(52) U.S. Cl.
CPC ..... *A24F 15/20* (2013.01); *A24F 25/00* (2013.01); *A45F 5/1525* (2025.01)

(58) Field of Classification Search
CPC ..... A24F 5/1525; A24F 15/20; A24F 25/00; A24F 25/02; B65D 30/22; B65D 33/06; B65D 85/12
USPC ..... 150/100, 106–126; 206/205–213.1, 206/242–275
See application file for complete search history.

(56) References Cited

U.S. PATENT DOCUMENTS 1,935,601 A * 11/1933 Winter ..... B65D 5/6697 206/524.4
2,079,401 A * 5/1937 Eisenberg ..... A45C 3/06 150/110
4,811,769 A * 3/1989 Phares ..... A45C 13/02 190/110
5,938,012 A * 8/1999 Yeager ..... B65D 81/22 206/256
6,068,113 A * 5/2000 Schmaling ..... A45C 13/103 206/213.1
7,909,234 B2 * 3/2011 Maistrellis ..... B42F 7/08 150/112
11,297,927 B1 * 4/2022 Johnson ..... A45F 3/02
D1,084,500 S 7/2025 Coppola
2002/0114539 A1 * 8/2002 Strevey ..... A45C 3/00 150/108
2010/0218862 A1 * 9/2010 Ellermeyer ..... A45C 11/00 150/111
2011/0259485 A1 * 10/2011 Burns ..... A45C 13/02 150/106

FOREIGN PATENT DOCUMENTS

GB 90053094080002 7/2018

* cited by examiner

*Primary Examiner* — Bryon P Gehman

(74) *Attorney, Agent, or Firm* — Knobbe, Martens, Olson & Bear LLP

(57) ABSTRACT

A cigar case opens in a clamshell manner and has a left side, a spine portion and a right side. A pocket on the left side and the right side can receive and hold multiple cigars in curved slots of a cedar wood spacer inside the pocket. The left side and right side have elastics to receive and hold accessories such as a cigar cutter, a cigar lighter and a personal cigar case.

21 Claims, 16 Drawing Sheets

CIGAR CASE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a case and more particularly to a travel case for holding cigars and cigar accessories, including a cigar cutter and cigar lighter.

Description of the Related Art

Cigar aficionados like to enjoy smoking cigars regularly while traveling, such as on cruises, or when dining. Such individuals enjoy smoking while conversing with others, and take great care of their cigars. However, existing generic travel bags are inadequate for carrying cigars. They may be too small and not allow the carrying of many cigars. Another detriment of existing generic travel bags is that cigars can slide or move within the bag and contact each other or other surfaces or contents of the bag, which may damage the skin or wrapper of the cigar. As such, generic travel bags are not suitable for use by cigar aficionados for carrying cigars.

SUMMARY

Accordingly, there is a need for an improved case (e.g., travel case, cross-body travel case) for carrying cigars that does not have the deficiencies noted above.

In accordance with one aspect of the disclosure, a cigar case is provided that can house multiple cigars spaced from each other to inhibit damage to the cigars while traveling, as well as house cigar accessories (e.g., cigar cutter, cigar lighter, smaller cigar case) and accommodate other components (e.g., tablet computer, such as an iPad).

In some aspects, the techniques described herein relate to a cigar case, including: a body having a rectangular shape, the body including: a pocket on a front side of the body, a zippered pocket on a rear side of the body; a handle on the rear side of the body; a zipper extending along at least three sides of the body, allowing the body to open in a clamshell manner when the zipper is opened; a first pocket on an inner left side of the body and a second pocket on an inner right side of the body, a border surrounding each of the first pocket on the inner left side of the body and the second pocket on the inner right side of the body, each of the first pocket and the second pocket having: a rear panel, a front panel connected to the rear panel by a gusset to define a space between the front panel and the rear panel configured to receive cigars therein, the front panel having a cutout at an upper end, a perforated subpocket on the rear panel, a flap movable between a first position against the front panel and under a strap attached to the front panel to close the space, and a second position extended away from the front panel to allow access to the space and perforated subpocket; an elastic on an upper portion of the border configured to removably receive and hold a cigar cutter or cigar lighter; an elastic on an outer lateral side portion of the border; and a cedar wood spacer removably disposed in the space, the spacer having a tapered upper side and a plurality of curved slots extending from the tapered upper side to a bottom side of the spacer, each of the curved slots configured to removably receive a cigar therein; and a spine portion between the inner left side of the body and the inner right side of the body, the spine portion having an elastic thereon configured to removably receive and hold a cigar case against the spine portion; a pair of buckles attached to opposite sides of the body; and a strap removably coupleable to the buckles and configured to extend over a user's shoulder or across a user's torso to wear the case, wherein the pocket on the front side of the body is configured to receive a tablet computer, and wherein the spacer is configured to maintain cigars disposed in the curved slots in place to inhibit sliding of the cigars in the space or bumping of the cigars against each other.

In some aspects, the techniques described herein relate to a cigar case, including: a body including: a pocket on a front side of the body, a zipper extending along at least three sides of the body, allowing the body to open in a clamshell manner when the zipper is opened; a first pocket on an inner left side of the body and a second pocket on an inner right side of the body, a border surrounding each of the first pocket on the inner left side of the body and the second pocket on the inner right side of the body, each of the first pocket and the second pocket having: a rear panel, a front panel connected to the rear panel by a gusset to define a space between the front panel and the rear panel configured to receive cigars therein, a perforated subpocket on the rear panel, a flap movable between a first position against the front panel and under a strap attached to the front panel to close the space, and a second position extended away from the front panel to allow access to the space and perforated subpocket; an elastic on an upper portion of the border configured to removably receive and hold a cigar cutter or cigar lighter; and a cedar wood spacer removably disposed in the space, the spacer having a plurality of curved slots extending from a tapered upper side to a bottom side of the spacer, each of the curved slots configured to removably receive a cigar therein; and a spine portion between the inner left side of the body and the inner right side of the body; wherein the spacer is configured to maintain cigars disposed in the curved slots in place to inhibit sliding of the cigars in the space or bumping of the cigars against each other.

In some aspects, the techniques described herein relate to a cigar case, including: a body including: a pocket on a front side of the body, a handle on a rear side of the body; a zipper extending along at least three sides of the body, allowing the body to open in a clamshell manner when the zipper is opened; a pocket on an inner left side of the body or an inner right side of the body, a border surrounding the pocket, the pocket having: a rear panel, a front panel connected to the rear panel by a gusset to define a space between the front panel and the rear panel configured to receive cigars therein, a perforated subpocket on the rear panel, a flap movable between a first position against the front panel and under a strap attached to the front panel to close the space, and a second position extended away from the front panel to allow access to the space and perforated subpocket; and an elastic on an upper portion of the border configured to removably receive and hold a cigar cutter or cigar lighter; and a spine portion between the inner left side of the body and the inner right side of the body.

DETAILED DESCRIPTION

Figure 1:
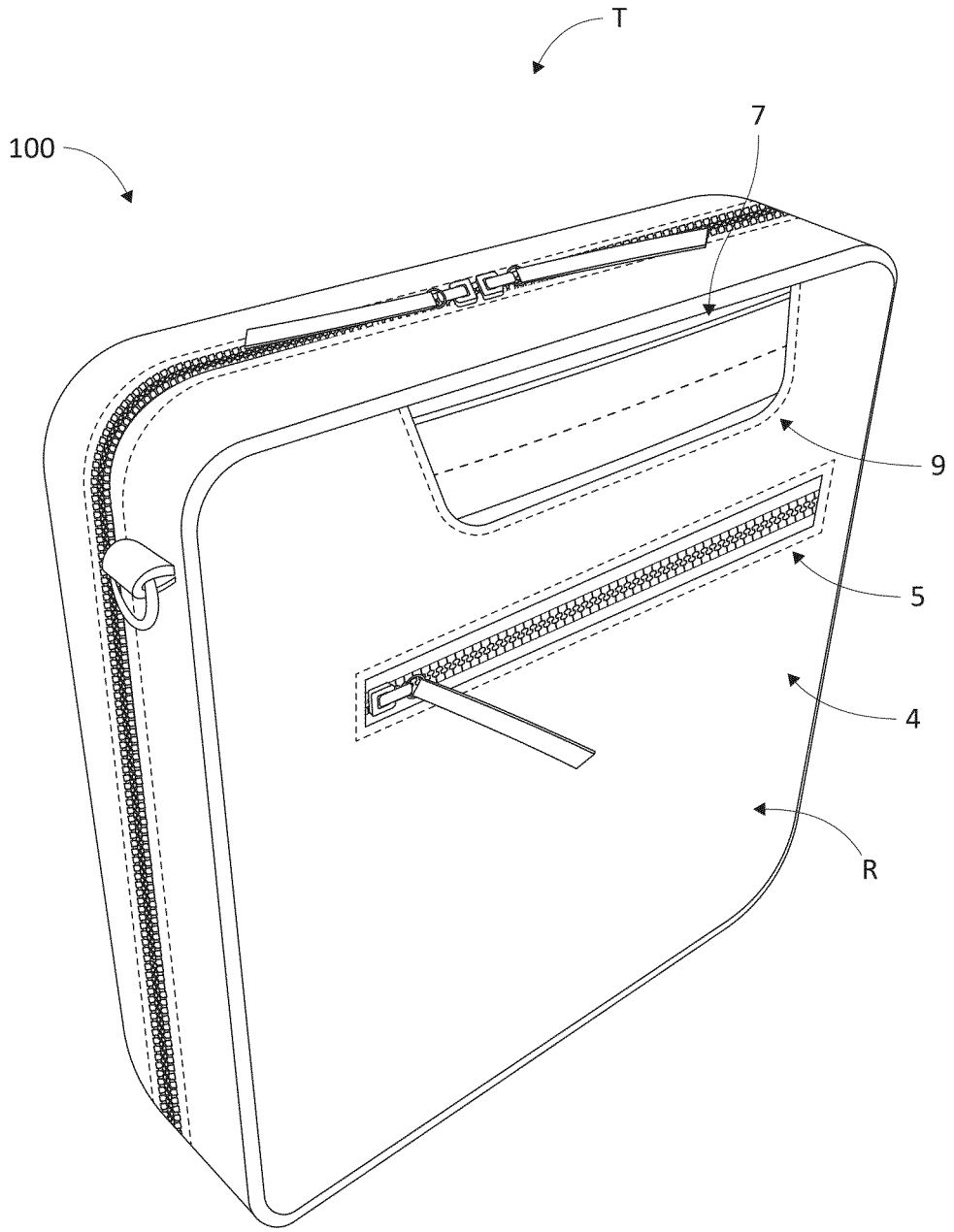
FIG. 1 is a perspective rear view of a cigar case when closed.
Figure 2:
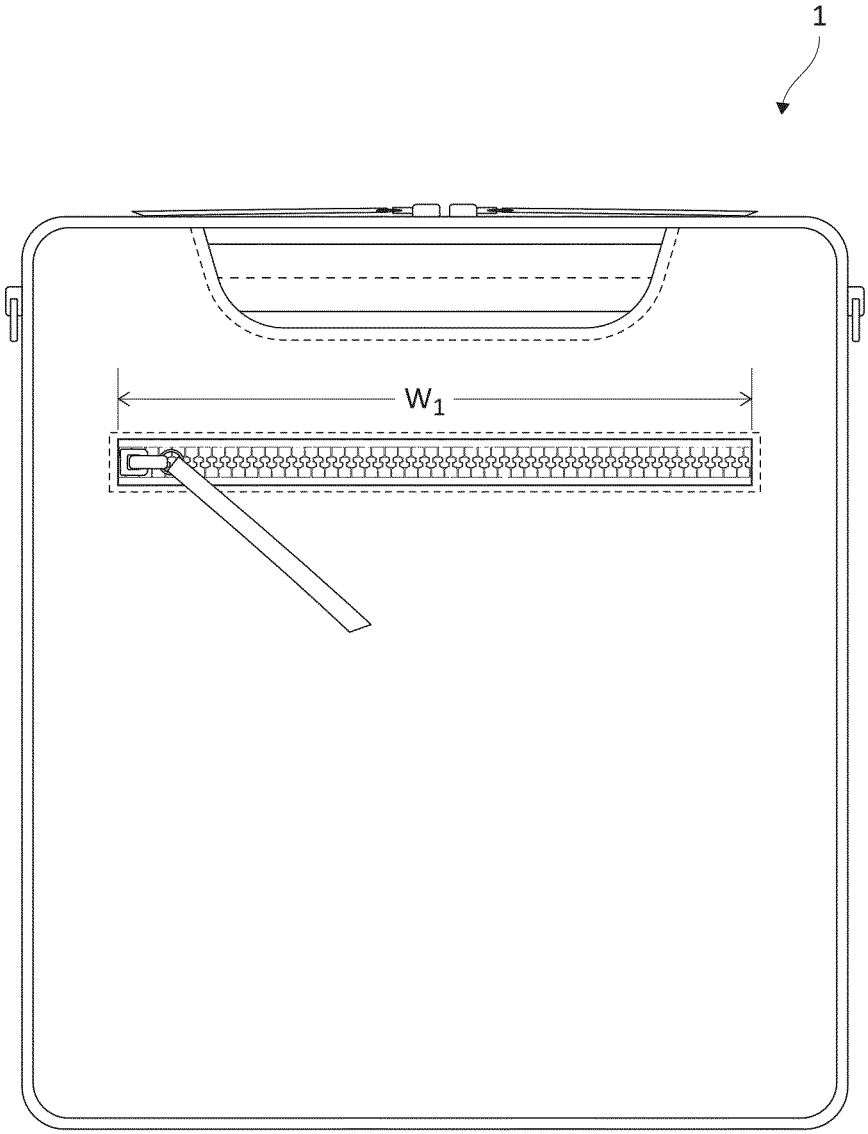
FIG. 2 is a rear view of the cigar case in FIG. 1.
Figure 3:
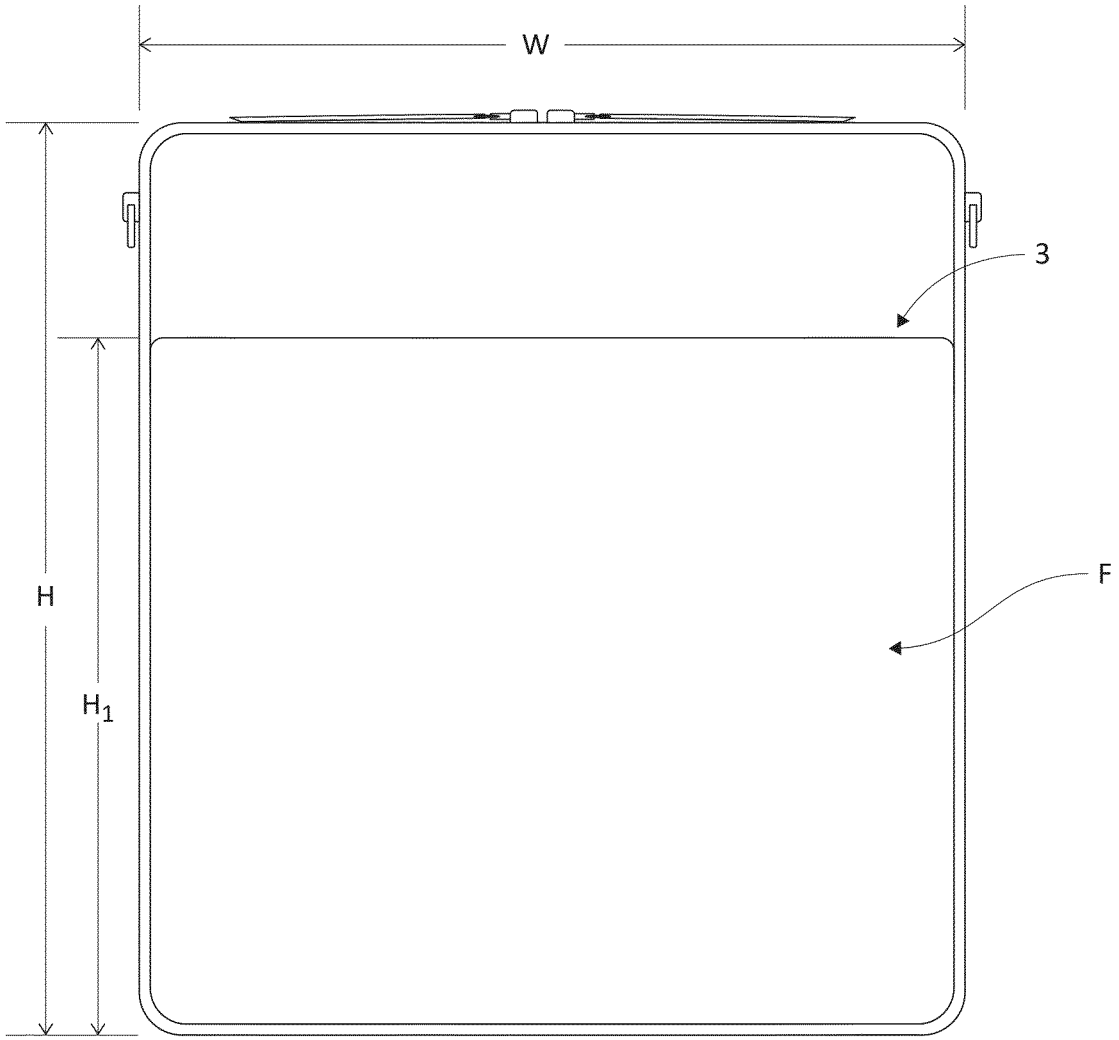
FIG. 3 is a front view of the cigar case in FIG. 1.
Figure 4:
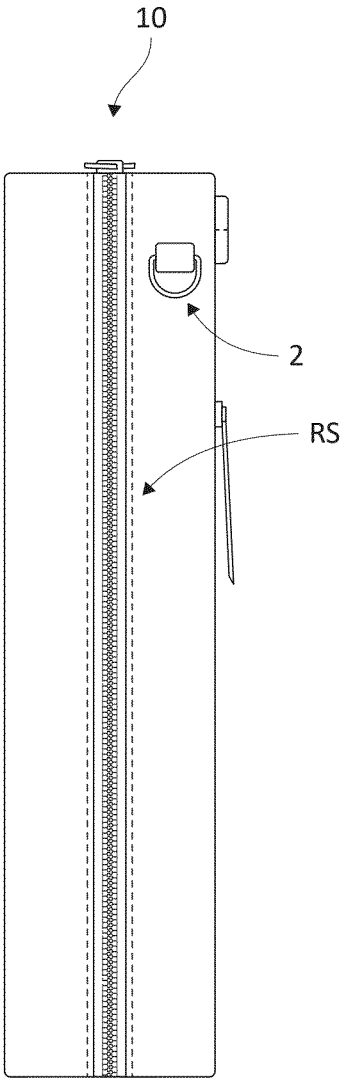
FIG. 4 is a right side view of the cigar case in FIG. 1.
Figure 5:
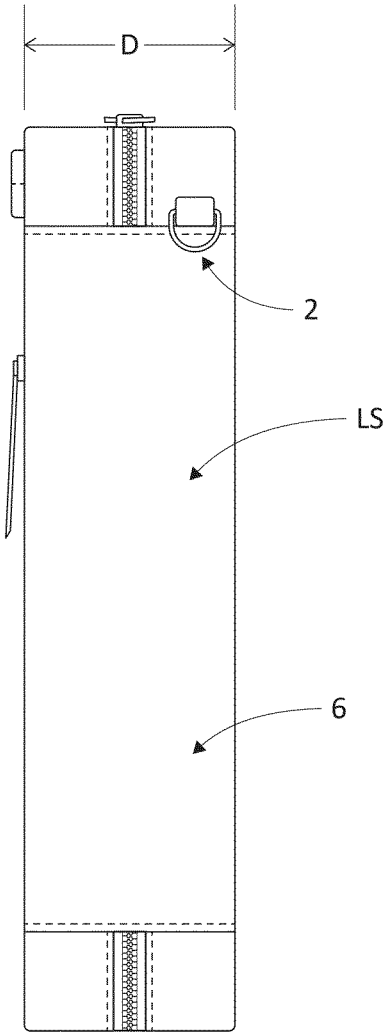
FIG. 5 is a left side view of the cigar case in FIG. 1.
Figure 6:
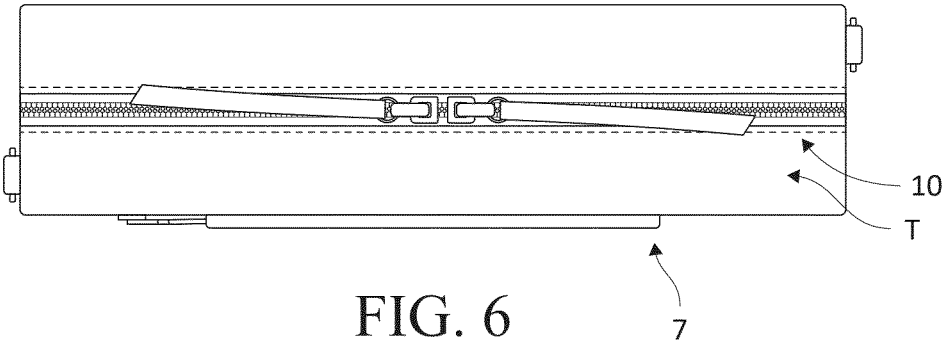
FIG. 6 is a top view of the cigar case in FIG. 1.
Figure 7:
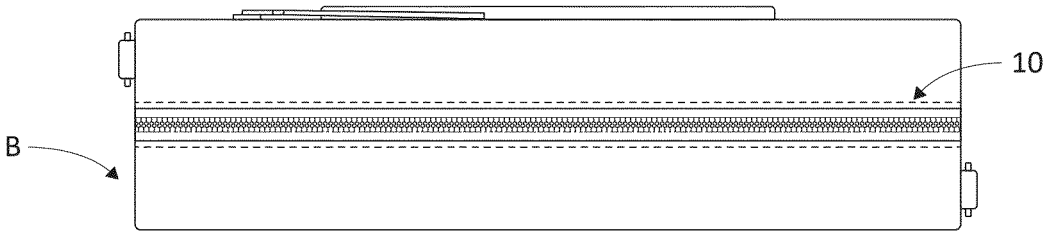
FIG. 7 is a bottom view of the cigar case in FIG. 1.
Figure 8:
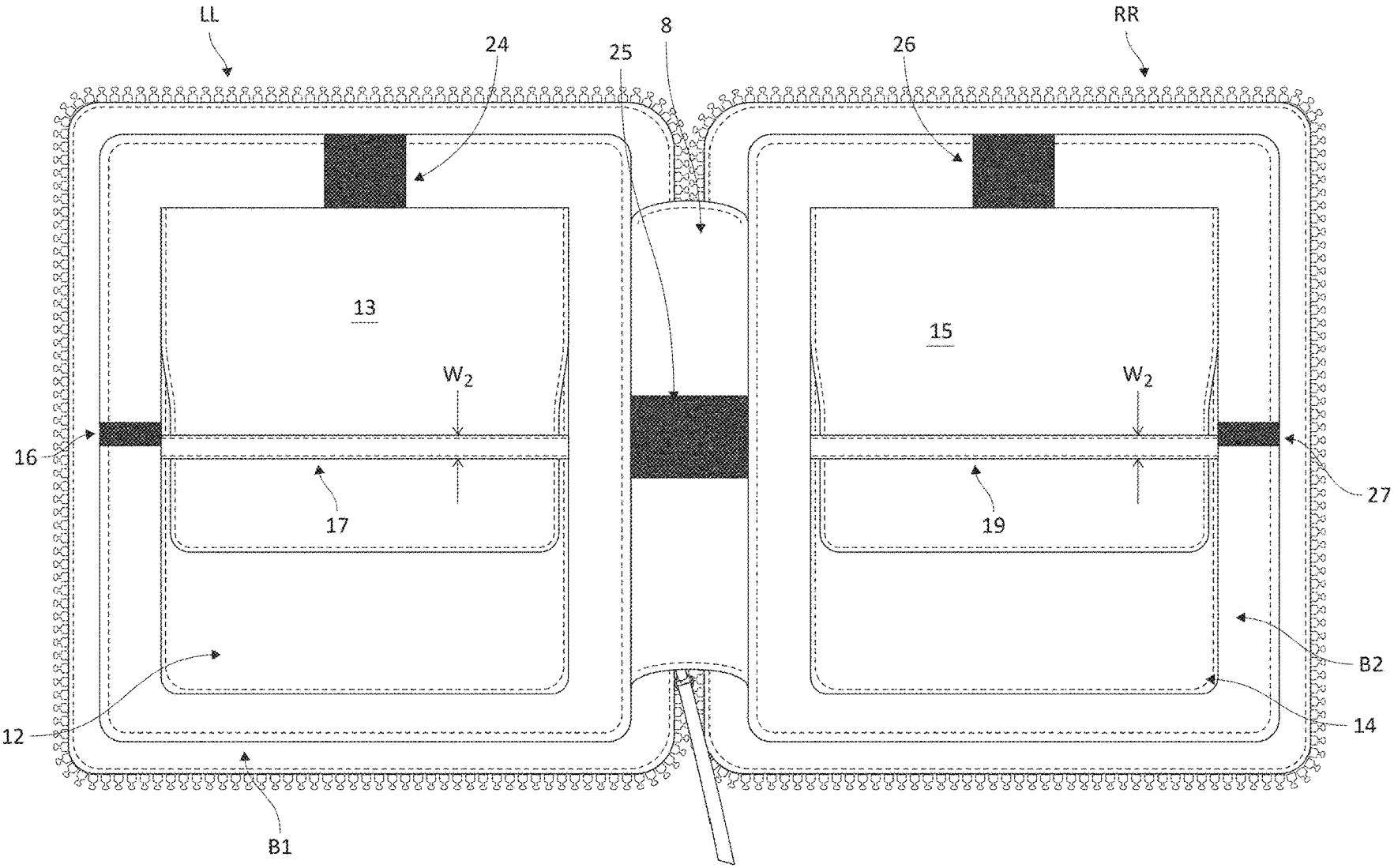
FIG. 8 shows the cigar case of FIG. 1 in an open position.
Figure 9:
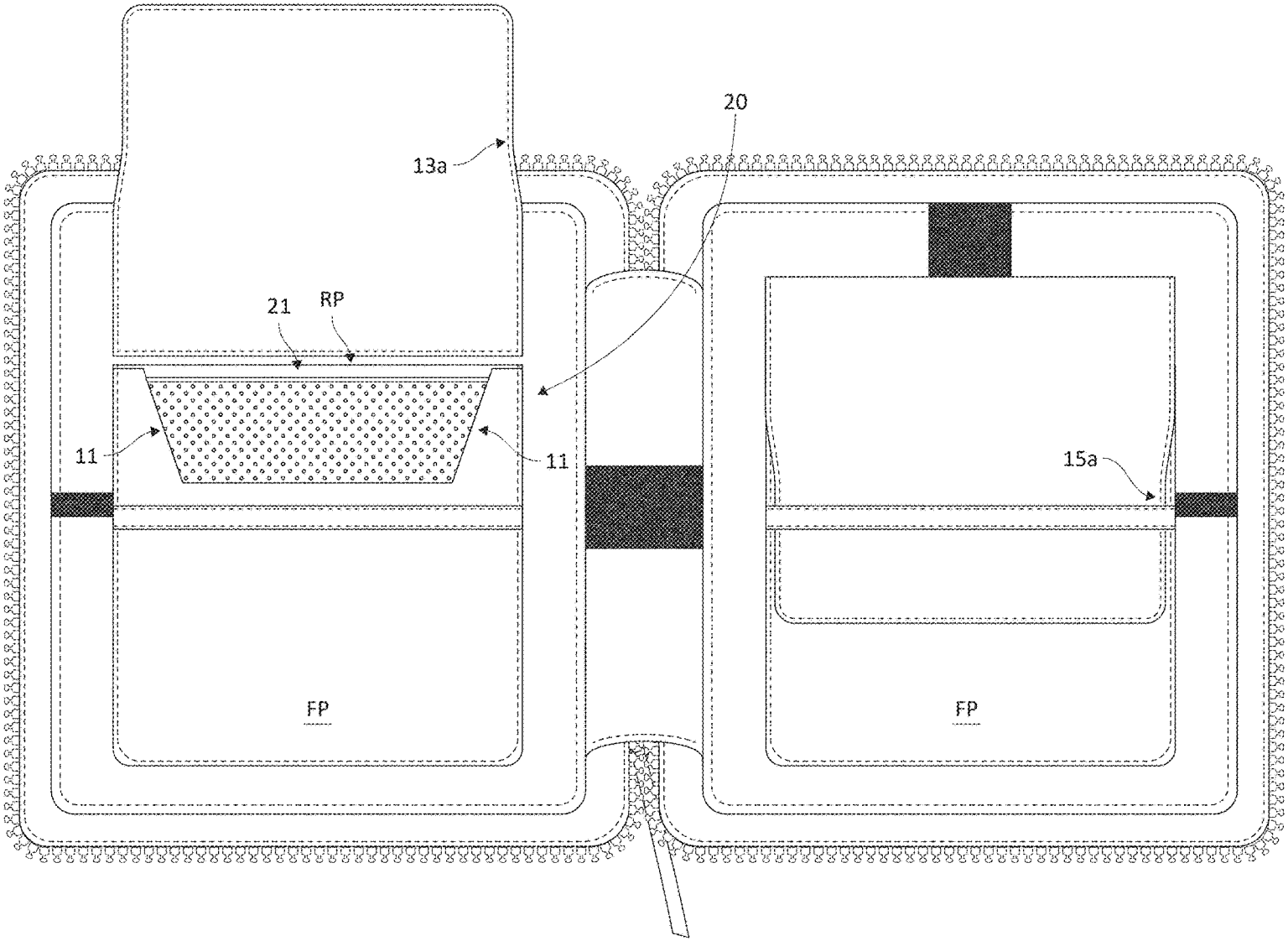
FIG. 9 shows the cigar case in FIG. 8 with one pocket open.
Figure 10:
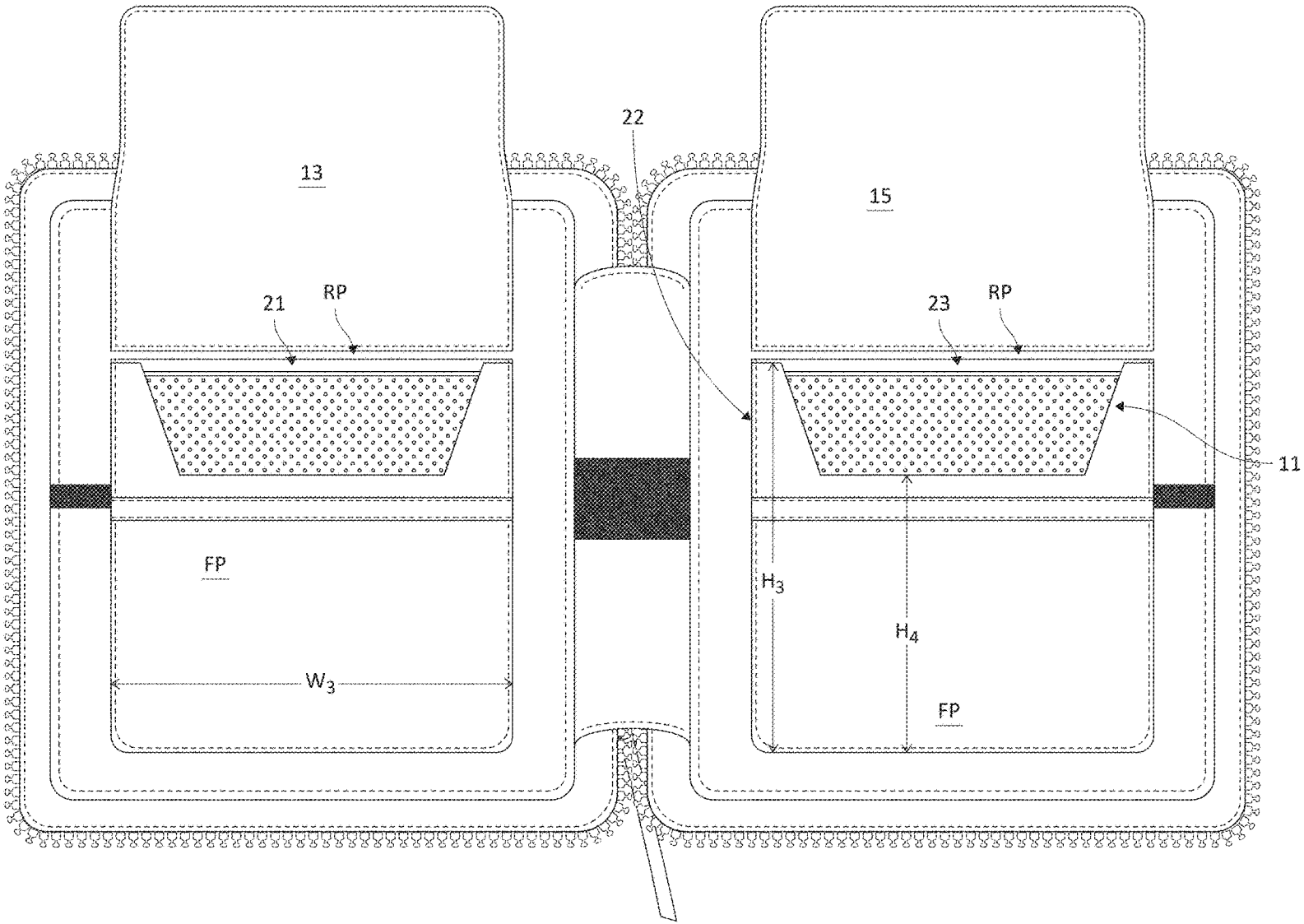
FIG. 10 shows the cigar case in FIG. 8 with both pockets open.
Figure 11:
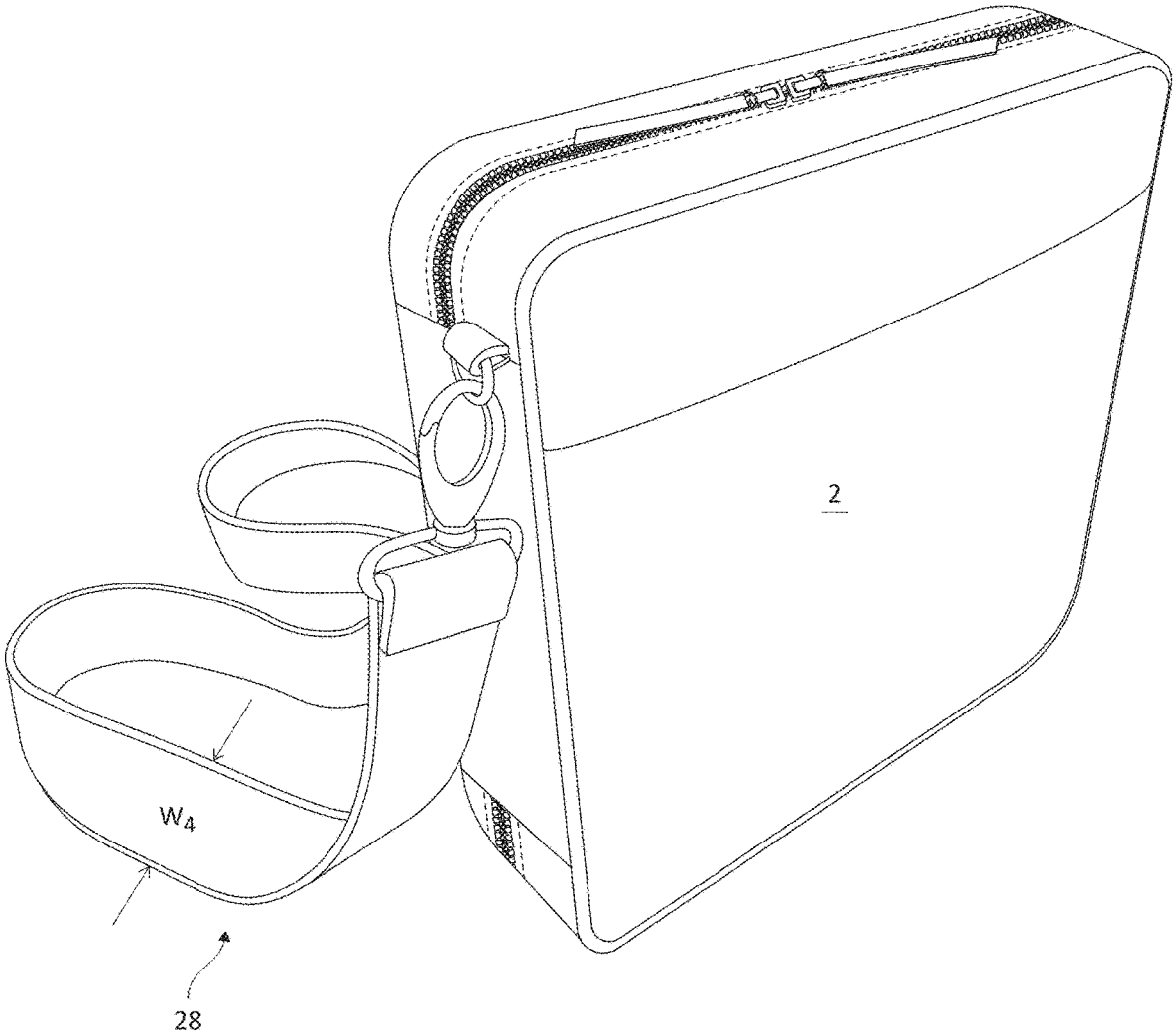
FIG. 11 is a perspective front view of the cigar case in FIG. 1 with a strap.
Figure 12:
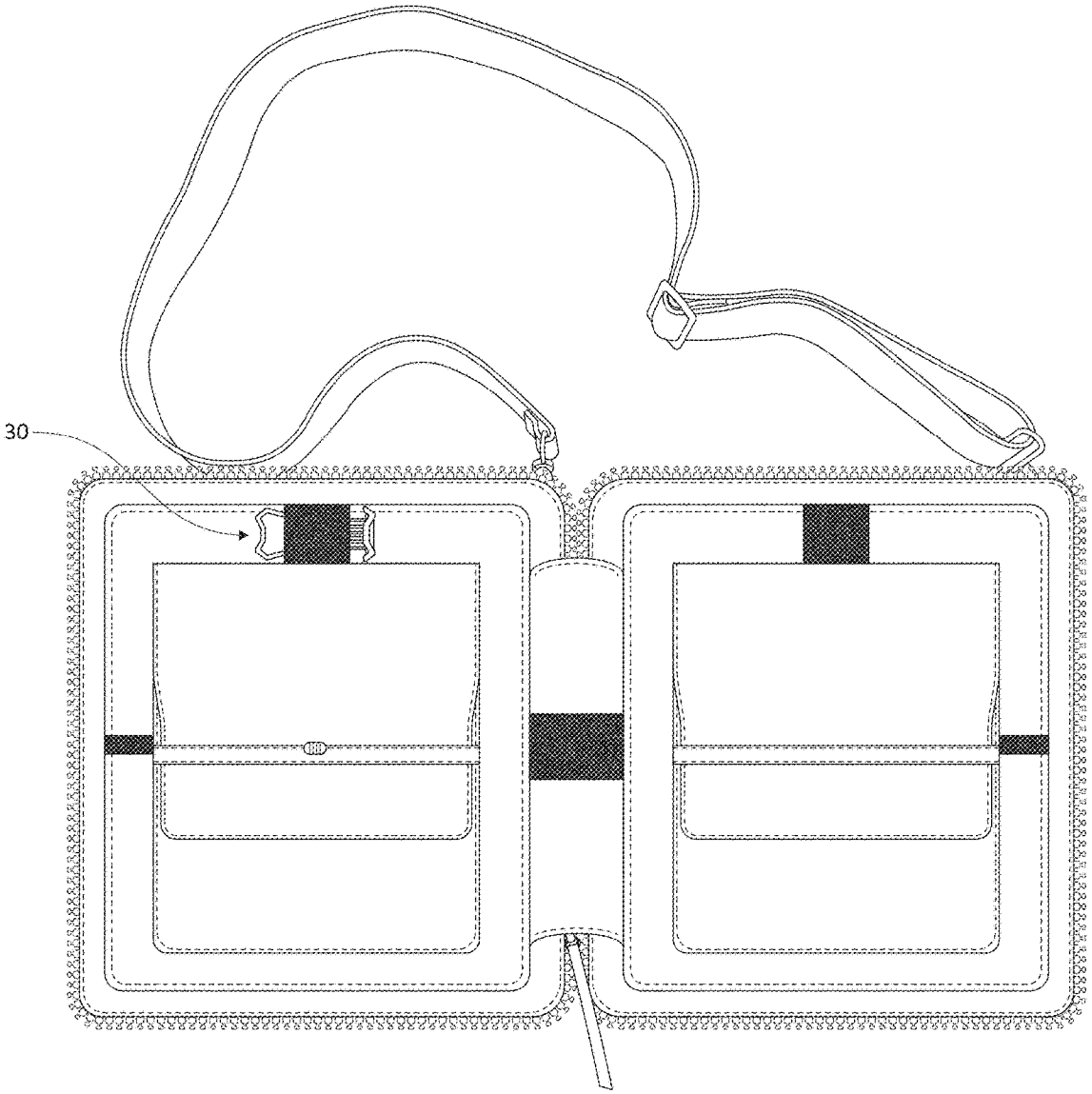
FIG. 12 shows the cigar case in FIG. 11 in an open position.

FIGS. 1-15 show a case 100 (e.g., travel case, carrying case) for use in carrying cigars, cigar accessories (e.g., cigar cutter, cigar lighter) and other objects (e.g., tablet computer, keys, wallet, etc.). In one example, the case 100 can have a body 1 made of leather or other suitable (flexible, non-rigid) materials. The case 100 can have a generally rectangular shape with a front side F, a rear side R, top side T, a bottom side B, a left side LS and a right side RS. The case 100 can have a height H from the bottom side B to the top side T, a width W from the left side LS to the right side RS, and a depth D from the front side F to the rear side R. In one example, the height H can be between 10 inches and 12 inches, such as 10½ inches. In one example, the width W can be between 9 inches and 12 inches, such as 10 inches. In one example, the depth D can be between 1½ inches and 3½ inches, such as 2¾ inches. The case 100 can have a gusset 6 on the left side L that extends from the front side F to the rear side R. The gusset 6 provides a space for branding opportunities and can display logos or trademarks. The case 100 can open in a clamshell manner, as shown in FIGS. 8-10, via a zipper 10 that extends along an entirety of the bottom side B, the top side T, the right side RS and a portion of the left side LS on either side of the gusset 6. The case 100 can have a buckle 2 on both the right side RS and the left side LS for removably coupling thereto a strap 28, as shown in FIG. 11, to allow a user to wear the case 100 over their shoulder or across their body. The strap 28 has a width W4. In one example, the width W4 of the strap 28 can be between 1 inch and 2 inches, such as 1½ inches.

The case 100 can have a pocket 4 on the rear side R closed by a closure 5 having a width W1. In one example, the width W1 of the closure 5 can be between 5 inches and 8 inches, such as 7 inches. In one example, the closure 5 is a zipper. The case 100 can have a handle 7 on the rear side R. The handle 7 can be a strip of material that extends across a recessed edge 9 of the rear side R and is attached to opposite sides of the recessed edge 9, allowing a user's fingers to pass under the handle 7 and between the handle 7 and the rear side R to allow the user to carry the case 100 (with one hand). In one example, the handle 7 can be adjacent the rear side R. In one example, the handle 7 can have a width of about 1 inch. The case 100 can have a pocket 3 on the front side F. The pocket 3 can have an opening at a height H1 from the bottom side B. In one example, the height H1 can be between 6 inches and 9 inches, such as 8 inches. The pocket 3 can have magnets 16 (see FIG. 15) to maintain the pocket 3 in a closed state when not in use or when the pocket 3 holds a small object (e.g., documents, keys) to securely retain such objects. The pocket 3 is sized to receive and hold objects such as a tablet computer (e.g., iPad).

FIGS. 8-10 show the case 100 in an open position (e.g., once the zipper 10 is opened). The case 100 opens in a clamshell manner and has a left side LL (inner left side of body 1) and a right side RR (inner right side of body 1). The left side LL has a pocket 12 (e.g., left pocket) and the right side RR has a pocket 14 (e.g., right pocket). The pocket 12 is surrounded by a border gap B1 and the pocket 14 is surrounded by a border gap B2. The left side LL has a flap 13 with a tapered edge 13*a* that can be moved between a closed position (shown in FIG. 8) to close the pocket 12, and an open position (shown in FIG. 9, away from the front panel FP) to allow access to the pocket 12. In the closed position the flap 13 can be passed under a strap 17 to secure the flap 13 in the closed position. The right side RR has a flap 15 with a tapered edge 15*a* that can be moved between a closed position (shown in FIG. 8) to close the pocket 14, and an open position (shown in FIG. 10, away from the front panel FP) to allow access to the pocket 14. In the closed position, the flap 15 can be passed under a strap 19 to secure the flap 15 in the closed position. The strap 17 and the strap 19 can have a width W2. In one example, the width W2 of the strap 19 can be ¾ inches.

The left side LL has one or more (e.g., one) elastics 24 (e.g., elastic strap) in an upper portion of the border gap B1 and the right side RR has one or more (e.g., one) elastics 26 (e.g., elastic strap) in an upper portion of the border gap B2. In one example, the one or more elastics 24, 26 have a width of ½ inch. The left side LL has one or more (e.g., one) elastics 16 (e.g., elastic strap) in a left outer lateral side portion of the border gap B1 and the right side RR has one or more (e.g., one) elastics 27 (e.g., elastic strap) in a right outer lateral side portion of the border gap B2. A spine portion 8 of the case 100 between the left side LL and the right side RR includes one or more elastics 25. In one example, the one or more elastics 25 have a width between 1 inch and 2 inches, such as 1½ inches. The one or more elastics 24 and the one or more elastics 26 can receive and hold a cigar cutter 30 (see FIG. 12) or a cigar lighter (not shown), or vice versa. The one or more elastics 16, 27 can receive and hold other accessories or components, such as pens, lights, etc. In one example, the one or more elastics 16, 27 can have a width of ½ inch. The one or more elastics 25 can receive and hold one or more accessories, such as a small travel case (not shown) that can retain one or two cigars (e.g., if a user wants to take a few cigars in their jacket or coat when going to dinner or an event). A bottom portion of the border gap B1, B2 can receive and house other accessories or components (e.g., a wireless tracking device, such as an AirTag device).

Figure 14:
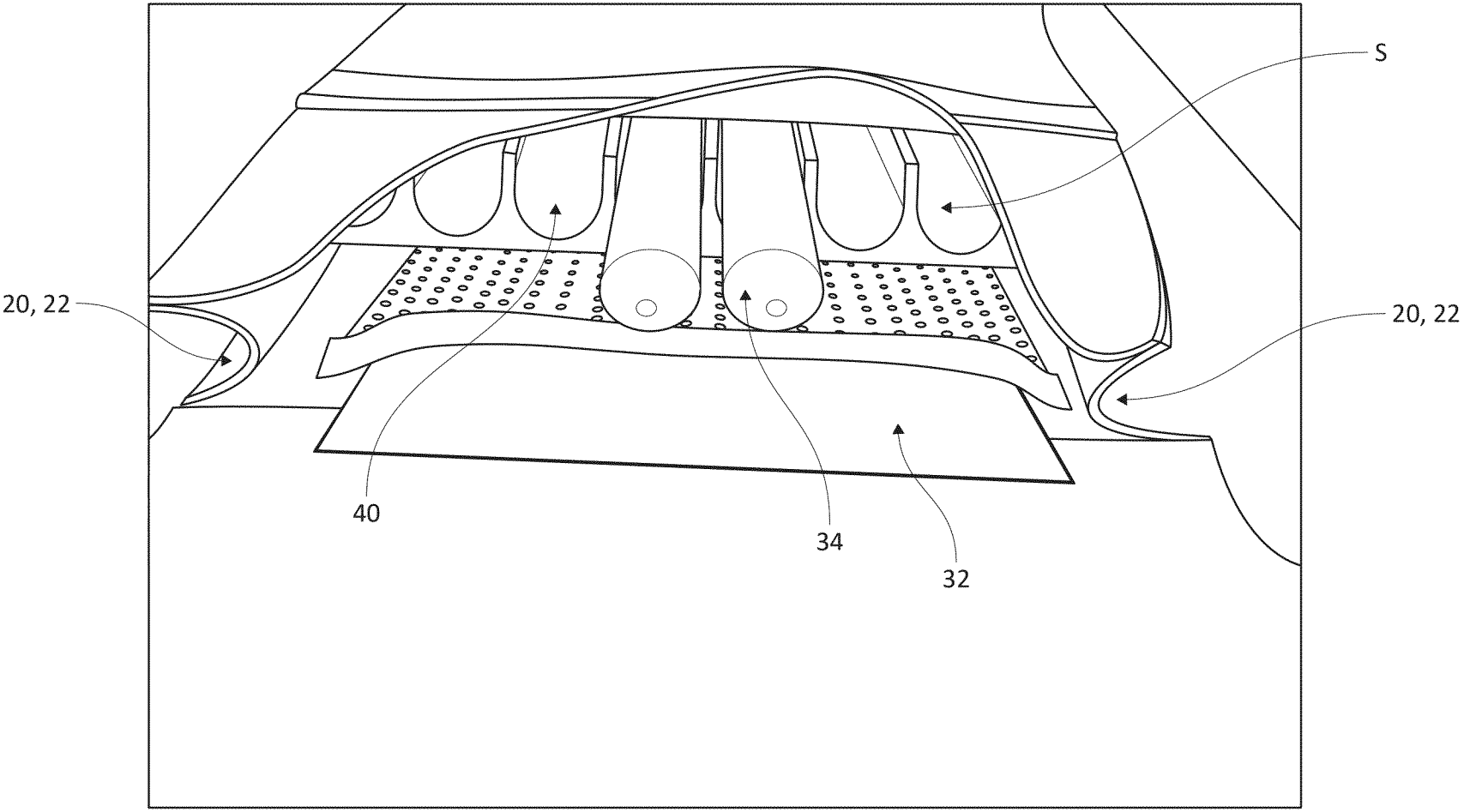
FIG. 14 shows a top view of a pocket in the cigar case of FIG. 1.
Figure 15:
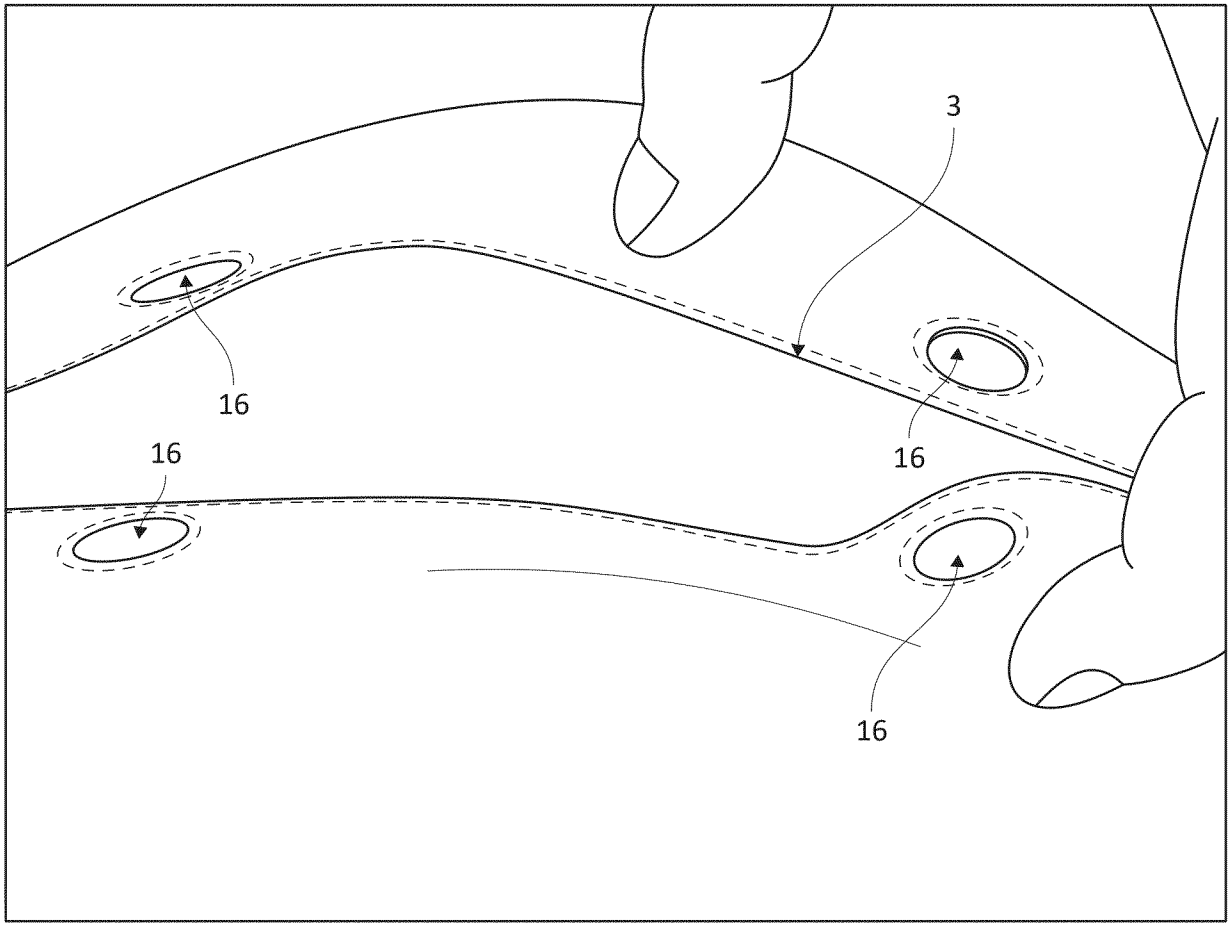
FIG. 15 shows a top view of a pocket on the front of the cigar case in FIG. 1.

With reference to FIGS. 9-10 and 14, the pocket 12 and the pocket 14 each have a front panel FP, a rear panel RP. The pocket 12 has a gusset 20 that extends on three sides of the pocket 12 between the rear panel RP and the front panel FP. The pocket 14 has a gusset 22 that extends on three sides of the pocket 14 between the rear panel RP and the front panel FP. The pocket 12 has a rear pocket 21 (or subpocket) that is perforated. The pocket 14 has a rear pocket 23 (or subpocket) that is perforated. The front panel FP of the pocket 12 and the pocket 14 has a width W3, and a cutout 11 between an outer height H3 and an inner height H4, the front panel FP having a tapered edge. In one example, the outer height H3 can be between 7 inches and 8 inches, such as 7¼ inches. In one example, the inner height H4 can be between 4½ inches and 6 inches, such as 5 inches. In one example, the width W3 can be between 6 inches and 9 inches, such as about 8 inches.

Figure 13:
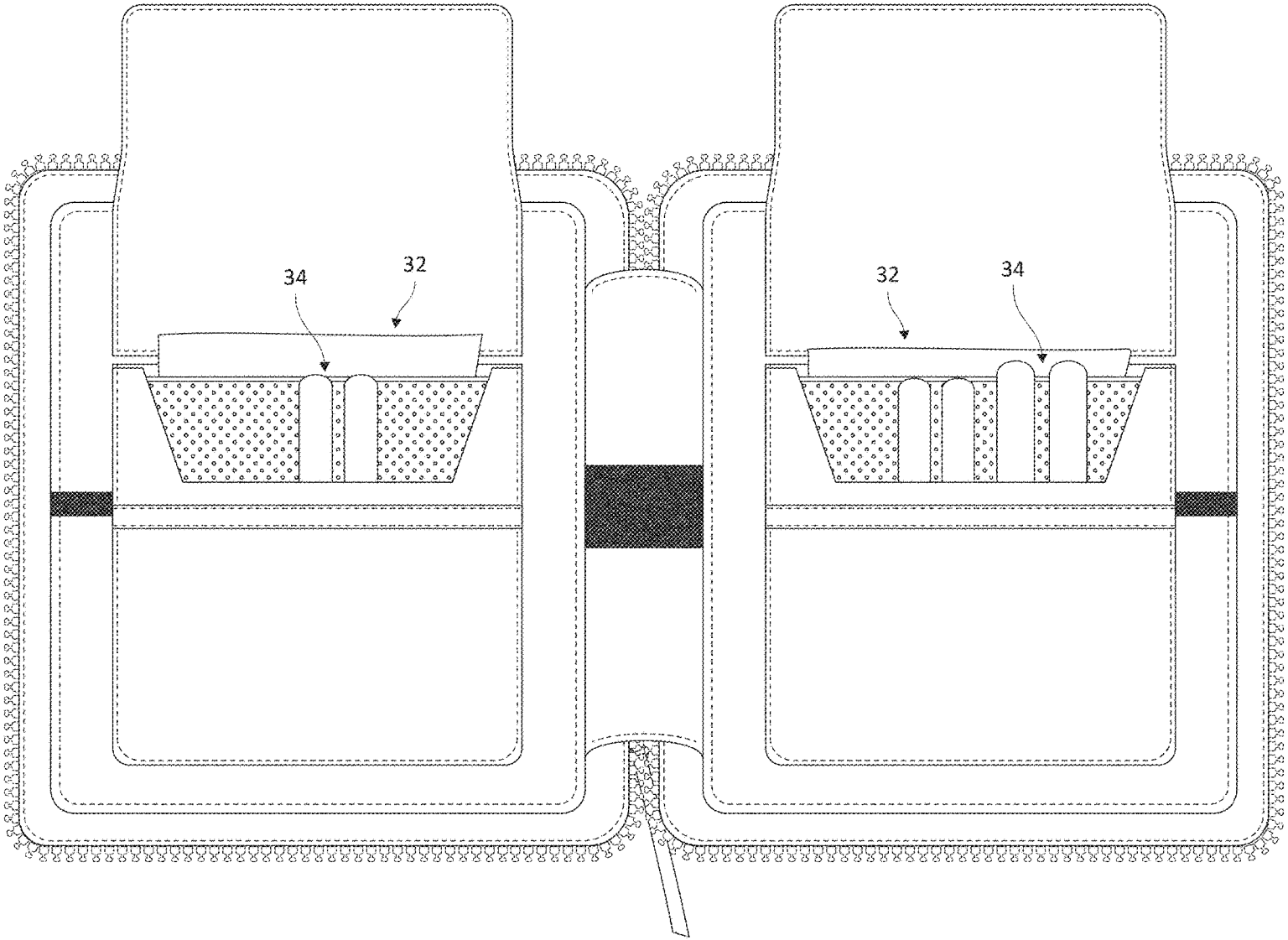
FIG. 13 shows the cigar case in FIG. 12 with both pockets open.

With reference to FIGS. 13-14, the case 100 can accommodate multiple cigars 34 in both the pocket 12 (left pocket) and the pocket 14 (right pocket), in a space S between the front panel FP and the rear panel RP. Additionally, the rear pocket 21 and the rear pocket 23 can receive and hold a humidity control pack 32 (e.g., Boveda pack) to facilitate maintaining the cigars 34 at optimal humidity to inhibit drying of the cigars 34. Additionally, the pocket 12 (left pocket) and the pocket 14 (right pocket), in particular the space S of each of the pockets 12, 14, is sized to receive a spacer 40 that receives and maintains the cigars 34 spaced from each other, thereby preventing the cigars 34 from contacting each other, and therefore preventing damage to the cigars 34 (e.g., damage to the skin/wrapper of the cigars 34) while being carried in the case 100.

Figure 16:
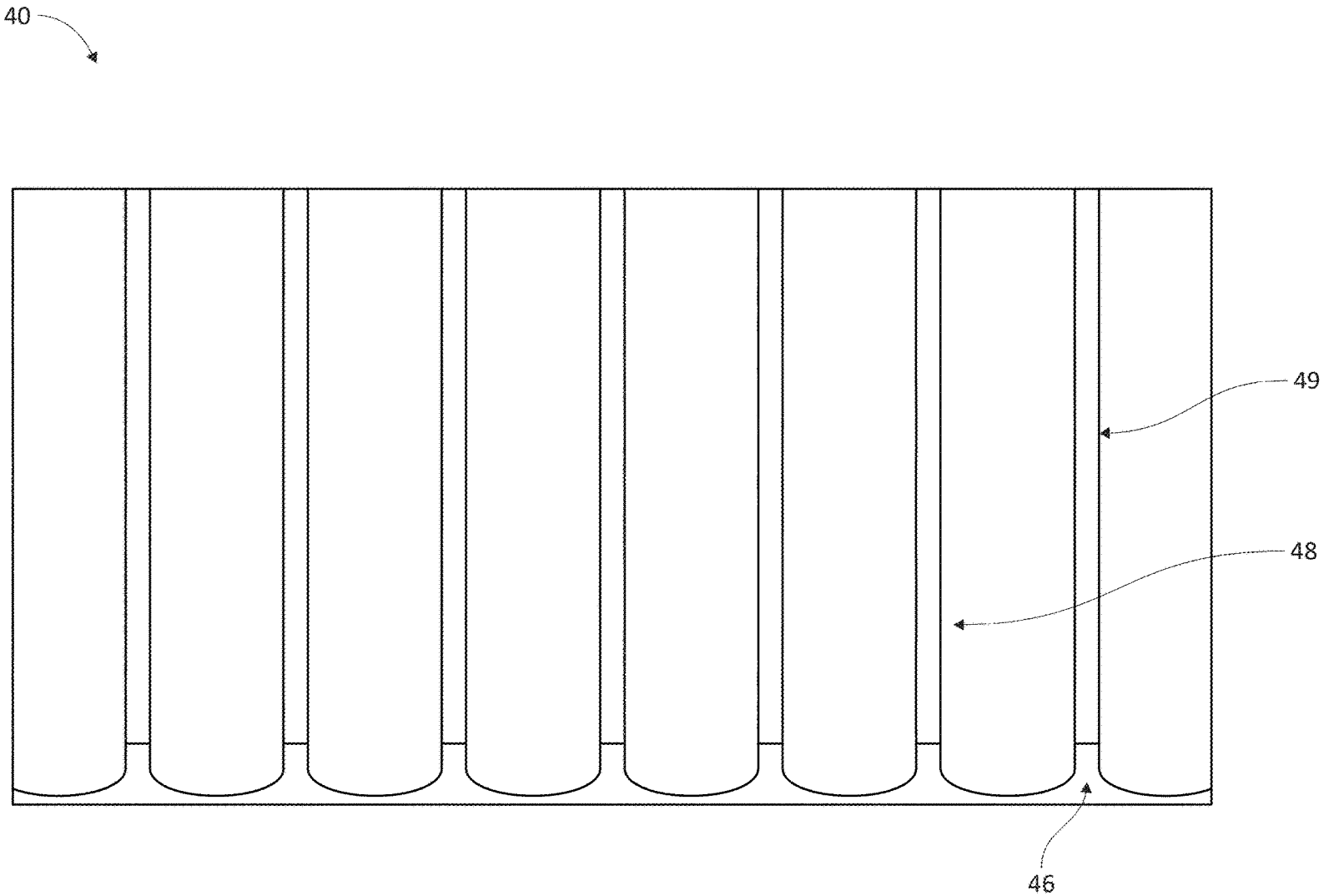
FIG. 16 shows a front view of a cigar spacer for use with the cigar case of FIG. 1.
Figure 17:
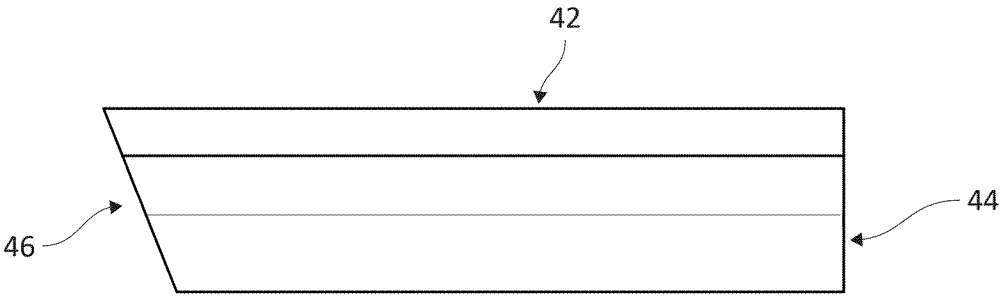
FIG. 17 shows a side view of the cigar spacer in FIG. 16.
Figure 18:
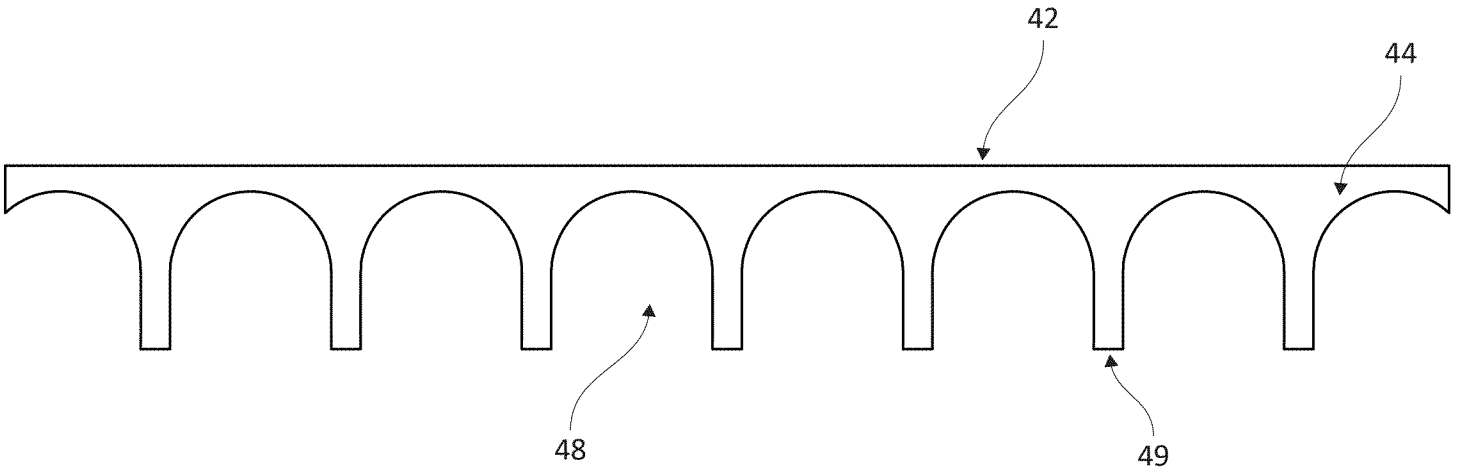
FIG. 18 shows a bottom view of the cigar spacer in FIG. 16.

FIGS. 16-18 show different views of the spacer 40. The spacer has a flat rear surface 42, a bottom surface or bottom side 44 that is perpendicular to the rear surface 42, and an upper side or surface 46 angled (e.g. angled or tapered toward the bottom surface 44) relative to the rear surface 42. The front side of the spacer 40 has a plurality of curved or U- or C-shaped slots 48 extending from the upper side 46 to the bottom surface 44, each slot 48 separated by a ridge 49 from an adjacent slot 48. Each slot 48 is sized to receive a cigar 34 therein. The angled upper side 46 advantageously facilitates insertion of the cigars 3 in the slots 48. The U- or C-shaped slots 48 advantageously provide a curved surface on which the cigars 34 rest, inhibiting snagging between the slots 48 and the cigars 34 to inhibit damage to the cigars 34 (e.g., damage to the skin/wrapper of the cigars 34). The spacer 40 can be made of cedar wood, which can advantageously help maintain optimal humidity for the cigars 34. The slots 48 prevent sliding and bumping of the cigars 34 (e.g., relative to each other).

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of the stated amount. As another example, in certain embodiments, the terms "generally parallel" and "substantially parallel" refer to a value, amount, or characteristic that departs from exactly parallel by less than or equal to 15 degrees.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A cigar case, comprising:

a body having a rectangular shape, the body comprising:

a pocket on a front side of the body, a zippered pocket on a rear side of the body;

a handle on the rear side of the body;

a zipper extending along at least three sides of the body, allowing the body to open in a clamshell manner when the zipper is opened;

a first pocket on an inner left side of the body and a second pocket on an inner right side of the body, a border surrounding each of the first pocket on the inner left side of the body and the second pocket on the inner right side of the body, each of the first pocket and the second pocket having:

a rear panel, a front panel connected to the rear panel by a gusset to define a space between the front panel and the rear panel configured to receive cigars therein, the front panel having a cutout at an upper end, a perforated subpocket on the rear panel, a flap movable between a first position against the front panel and under a strap attached to the front panel to close the space, and a second position extended away from the front panel to allow access to the space and perforated subpocket;

an elastic on an upper portion of the border configured to removably receive and hold a cigar cutter or cigar lighter;

an elastic on an outer lateral side portion of the border; and a cedar wood spacer removably disposed in the space, the spacer having a tapered upper side and a plurality of curved slots extending from the tapered upper side to a bottom side of the spacer, each of the curved slots configured to removably receive a cigar therein; and a spine portion between the inner left side of the body and the inner right side of the body, the spine portion having an elastic thereon configured to removably receive and hold a cigar case against the spine portion;

a pair of buckles attached to opposite sides of the body; and a strap removably coupleable to the buckles and configured to extend over a user's shoulder or across a user's torso to wear the case, wherein the pocket on the front side of the body is configured to receive a tablet computer, and wherein the spacer is configured to maintain cigars disposed in the curved slots in place to inhibit sliding of the cigars in the space or bumping of the cigars against each other.

2. The cigar case of claim 1, wherein the flap comprises a tapered edge.

3. The cigar case of claim 1, wherein the pocket on the front side of the body comprises multiple magnets to facilitate holding the pocket in a closed position.

4. The cigar case of claim 1, wherein the perforated subpocket is configured to receive and hold a humidity control pack.

5. The cigar case of claim 1, wherein the plurality of curved slots in the cedar wood spacer are six curved slots.

6. The cigar case of claim 1, wherein the plurality of curved slots are U-shaped or C-shaped slots.

7. The cigar case of claim 1, wherein the body has a greater height than width.

8. A cigar case, comprising:

a body comprising:

a pocket on a front side of the body, a zipper extending along at least three sides of the body, allowing the body to open in a clamshell manner when the zipper is opened;

a first pocket on an inner left side of the body and a second pocket on an inner right side of the body, a border surrounding each of the first pocket on the inner left side of the body and the second pocket on the inner right side of the body, each of the first pocket and the second pocket having:

a rear panel, a front panel connected to the rear panel by a gusset to define a space between the front panel and the rear panel configured to receive cigars therein, a perforated subpocket on the rear panel, a flap movable between a first position against the front panel and under a strap attached to the front panel to close the space, and a second position extended away from the front panel to allow access to the space and perforated subpocket;

an elastic on an upper portion of the border configured to removably receive and hold a cigar cutter or cigar lighter; and a cedar wood spacer removably disposed in the space, the spacer having a plurality of curved slots extending from a tapered upper side to a bottom side of the spacer, each of the curved slots configured to removably receive a cigar therein; and a spine portion between the inner left side of the body and the inner right side of the body;

wherein the spacer is configured to maintain cigars disposed in the curved slots in place to inhibit sliding of the cigars in the space or bumping of the cigars against each other.

9. The cigar case of claim 8, wherein the flap comprises a tapered edge.

10. The cigar case of claim 8, wherein the pocket on the front side of the body comprises multiple magnets to facilitate holding the pocket in a closed position.

11. The cigar case of claim 8, wherein the perforated subpocket is configured to receive and hold a humidity control pack.

12. The cigar case of claim 8, wherein the plurality of curved slots in the cedar wood spacer are six curved slots.

13. The cigar case of claim 8, wherein the plurality of curved slots are U-shaped or C-shaped slots.

14. The cigar case of claim 8, wherein the body has a greater height than width.

15. A cigar case, comprising:

a body comprising:

a pocket on a front side of the body, a handle on a rear side of the body;

a zipper extending along at least three sides of the body, allowing the body to open in a clamshell manner when the zipper is opened;

a pocket on an inner left side of the body or an inner right side of the body, a border surrounding the pocket on the inner left side of the body or the inner right side of the body, the pocket having:

a rear panel, a front panel connected to the rear panel by a gusset to define a space between the front panel and the rear panel configured to receive cigars therein, a perforated subpocket on the rear panel, a flap movable between a first position against the front panel and under a strap attached to the front panel to close the space, and a second position extended away from the front panel to allow access to the space and perforated subpocket; and an elastic on an upper portion of the border configured to removably receive and hold a cigar cutter or cigar lighter; and a spine portion between the inner left side of the body and the inner right side of the body.

16. The cigar case of claim 15, wherein the flap comprises a tapered edge.

17. The cigar case of claim 15, wherein the pocket on the front side of the body comprises multiple magnets to facilitate holding the pocket in a closed position.

18. The cigar case of claim 15, wherein the perforated subpocket is configured to receive and hold a humidity control pack.

19. The cigar case of claim 15, wherein the body has a greater height than width.

20. The cigar case of claim 15, further comprising a spacer removably disposed in the space, the spacer having a plurality of curved slots, each of the curved slots configured to removably receive a cigar therein, the spacer is configured to maintain cigars disposed in the curved slots in place to inhibit sliding of the cigars in the space or bumping of the cigars against each other.

21. The cigar case of claim 15, wherein the spine portion has an elastic thereon configured to removably receive and hold a cigar case against the spine portion.

* * * * *